US005758698A

United States Patent [19]

Kaneko

[11] Patent Number: 5,758,698

[45] Date of Patent: Jun. 2, 1998

[54] FILL SYSTEM INCLUDING A VALVE ASSEMBLY AND CORRESPONDING STRUCTURE FOR REDUCING THE MIXING OF PRODUCT AND AIR DURING CONTAINER FILLING

[75] Inventor: Yutaka Kaneko, Wheeling, Ill.

[73] Assignee: Tetra Laval Holdings & Finance, S.A., Pully, Switzerland

[21] Appl. No.: 693,810

[22] Filed: Aug. 1, 1996

[51] Int. Cl.[6] ..... B67C 3/26; B67C 3/34

[52] U.S. Cl. ..... 141/263; 141/148; 141/152; 141/172; 141/251; 141/255; 141/266; 141/270; 141/275; 141/318; 141/374

[58] Field of Search ..... 141/263, 266, 141/148, 149, 152, 172, 251, 255, 275, 270, 114, 318, 374, 375, 18, 382, 383, 264, 386; 222/490, 494; 239/DIG. 12, 602; 277/197

[56] References Cited

U.S. PATENT DOCUMENTS

| | | | |
|---|---|---|---|
| 194,726 | 8/1877 | Ross . | |
| 872,161 | 11/1907 | Whitehorn | 141/275 |
| 1,621,638 | 3/1927 | McIntyre et al. . | |
| 2,136,224 | 11/1938 | Weinreich | 141/255 |
| 2,213,998 | 9/1940 | Sifkovitz . | |
| 2,608,335 | 8/1952 | Rohdin . | |
| 2,651,445 | 9/1953 | Kennedy, Jr. . | |
| 2,710,121 | 6/1955 | Rees . | |
| 2,723,069 | 11/1955 | Shanhouse et al. . | |
| 2,763,416 | 9/1956 | Wormser . | |
| 2,839,094 | 6/1958 | Reno . | |
| 2,874,734 | 2/1959 | Luckock et al. . | |
| 2,913,016 | 11/1959 | Luther . | |
| 2,923,272 | 2/1960 | Emmert . | |
| 3,005,473 | 10/1961 | Ring . | |
| 3,106,231 | 10/1963 | Lehmann . | |
| 3,330,310 | 7/1967 | Heffelfinger et al. . | |
| 3,402,857 | 9/1968 | Ecklund et al. . | |
| 3,486,840 | 12/1969 | Burton et al. . | |
| 3,924,666 | 12/1975 | Raison . | |
| 4,050,473 | 9/1977 | Cho . | |
| 4,073,307 | 2/1978 | Royce . | |
| 4,074,836 | 2/1978 | Muller, Jr. . | |
| 4,185,669 | 1/1980 | Jevakohoff . | |
| 4,235,265 | 11/1980 | Feliks . | |
| 4,506,710 | 3/1985 | Sawvel | 141/374 |
| 4,537,335 | 8/1985 | Rangwala et al. . | |
| 4,606,382 | 8/1986 | Biller et al. . | |
| 4,792,068 | 12/1988 | Trygg . | |
| 4,815,666 | 3/1989 | Gacka et al. . | |
| 5,287,997 | 2/1994 | Rodrigue et al. . | |
| 5,309,961 | 5/1994 | Franke et al. | 222/490 |
| 5,375,813 | 12/1994 | Rozinsky . | |
| 5,469,897 | 11/1995 | Haytner et al. | 141/386 |

*Primary Examiner*—Henry J. Recla
*Assistant Examiner*—Timothy L. Maust
*Attorney, Agent, or Firm*—Michael A. Catania

[57] ABSTRACT

A filling system for filling a container is set forth. The container to be filled has a bottom portión and a plurality of sidewalls defining a container cross-section. The filling system comprises a fill pipe having a product inlet and a product outlet, a valve rod disposed in the fill pipe, a flexible outlet extension, and an umbrella-shaped sealing member having a bottom portion. The valve rod and the sealing member are movable between a first position in which the sealing member engages and seals the product outlet and a second position in which the sealing member is disengaged from the product outlet. The bottom portion of the sealing member is preferably shaped to conform to the interior bottom portion of the container. The flexible outlet extension extends from the product outlet and is dimensioned to engage and conform to the sidewalls of the container during filling thereby to inhibit mixing of product and air during the filling cycle. Additionally, the bottom portion of the sealing member may be used to engage the bottom of the container to assist in displacing air from a sealing region defined by the flexible outlet extension and the walls of the container.

26 Claims, 7 Drawing Sheets

FILL SYSTEM INCLUDING A VALVE ASSEMBLY AND CORRESPONDING STRUCTURE FOR REDUCING THE MIXING OF PRODUCT AND AIR DURING CONTAINER FILLING

FIELD OF THE INVENTION

The present invention relates to a method and apparatus for filling containers, and more particularly, to a filling system and corresponding valve assembly of a packaging machine for reducing the mixing of product and air during container filling.

BACKGROUND

Packaging machines are known that integrate the various components necessary to fill and seal a container into a single machine unit. This packaging process, generally stated, includes feeding carton blanks into the machine, sealing the bottom of the cartons, filling the cartons with the desired contents, sealing the tops of the cartons, and then off loading the filled cartons for shipping.

Trends within the field of packaging machines point toward increasingly high capacity machines intended for rapid, continuous filling and sealing of a very large number of identical or similar packaging containers, e.g., containers of the type intended for liquid contents such as milk, juice, and the like. One such machine is disclosed in U.S. Pat. No. 5,488,812, issued Feb. 6, 1996, and titled "Packaging Machine". The machine disclosed in the '812 patent includes a plurality of processing stations, each station implementing one or more processes to form, fill, and seal the containers. Each of the processing stations is driven by one or more servomotors that drive the various components of each of the processing stations.

The increased throughput and decreased size requirements of packagers on their packaging machines have increased the demands that are placed on the fill systems that are employed. Various apparatus and corresponding methods for filling containers, such as gable-top containers, have therefore been devised for these machines. In accordance with one of the more popular filling methods, the container is lifted from a conveyor to a fill pipe by means of a lifting mechanism. The container lifting mechanism gradually lowers the container as product is dispensed through the fill tube. The container then again engages the conveyor where it is transported to a top sealing station. Such a method is utilized in TR/7™ and TR/8™ packaging machines manufactured and available from Tetra Pak, Inc.

Alternatively, the filling and top sealing operations may be performed at a single location within the machine. In such instances, the container may be top sealed after it has been lowered from the fill pipe. Such a method and apparatus are shown and described in the foregoing '812 patent, and, further, in U.S. application Ser. No. 08/315,414, filed Sep. 28, 1994, and entitled "Control System For A Packaging Machine".

One problem encountered when attempting to increase the speed with which a container is filled with product relates to the foaming that occurs as a result of air and product mixing in the container. Generally stated, foaming increases as the speed with which the container is filled increases. When foaming is excessive, the product splashes into the sealing areas of the container resulting in improper sealing in subsequent sealing operations and/or contamination of the sealing area resulting in a reduction in the hygiene of the seal than would otherwise be obtained. The rate at which the container may be filled is thus limited by the foaming that occurs for a given fill rate.

SUMMARY OF THE INVENTION

A filling system for filling a container is set forth. The container to be filled has a bottom portion and a plurality of sidewalls defining a container cross-section. The filling system comprises a fill pipe having a product inlet and a product outlet, a valve rod disposed in the fill pipe, a flexible outlet extension, and an umbrella-shaped sealing member having a bottom portion. The valve rod and the sealing member are movable between a first position in which the sealing member engages and seals the product outlet and a second position in which the sealing member is disengaged from the product outlet. The bottom portion of the sealing member is preferably shaped to conform to the interior bottom portion of the container. The flexible outlet extension extends from the product outlet and is dimensioned to engage and conform to the sidewalls of the container during filling thereby to inhibit mixing of product and air during the filling cycle. Additionally, the bottom portion of the sealing member may be used to engage the bottom of the container to assist in displacing air from a sealing region defined by the flexible outlet extension and the walls of the container.

Other advantages of the present invention will become apparent upon reading the following detailed description and appended claims, and upon reference to the accompanying drawings.

DETAILED DESCRIPTION OF THE PREFERRED EMBODIMENT

Figure 1:
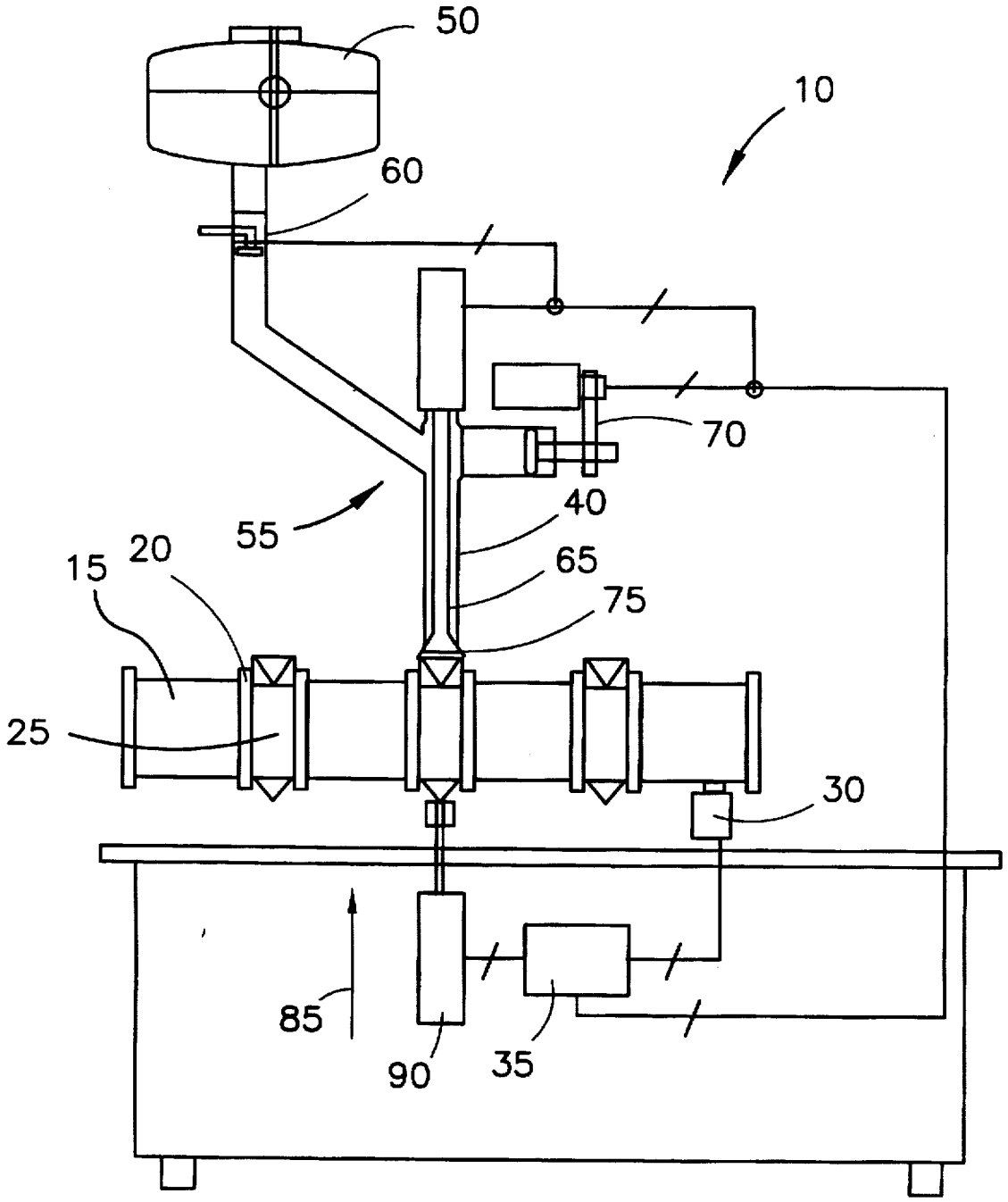
FIG. 1 is a diagrammatic view of a typical filling machine that may be used in connection with the disclosed apparatus.

FIG. 1 is a diagrammatic view of one of the many types of filling machines that may utilize a filling system, shown generally at 10, having an umbrella valve and associated structures constructed and operated in the manner described below. As shown in FIG. 1, a conveyor 15 having a plurality of carton support members 20 is driven by, for example, a motor. The support members 20 each support a single, open topped carton 25 that has its bottom sealed. The conveyor 15 is driven by motor 30 under the control of, for example, a programmable control system 35, or the like, to present the containers 25 successively below a fill pipe 40 of the fill system 10.

A storage or balance tank 50 containing a liquid product is connected to provide a flow of the liquid product through a flow control system 55. The flow control system, generally stated, comprises an inlet valve 60, an umbrella valve assembly 65, a pump mechanism 70, the fill pipe 40, and flexible outlet extension 75. The inlet and umbrella valves 60 and 65 are controlled to control the flow of the liquid product into and from the pump chamber of the pump mechanism. The pump mechanism 70 may be any type of pump mechanism, such as one disclosed in U.S. Pat. No. 4,877,160, which patent is incorporated by reference. The pump mechanism 70 may be driven, for example, by a servomotor under the direction of the programmable control system 35.

As illustrated, the containers 25 are successively brought below the umbrella valve outlet for filling with the liquid product. To this end, each container is lifted in a direction of arrow 85 so that the outlet end of the umbrella valve assembly 65 and the flexible outlet extension 75 are disposed interior to the container. This lifting may be done using a lifting mechanism 90 that executes a motion profile under the direction of, for example, the programmable control system 35. One such lifter mechanism and corresponding carton gripping mechanism are disclosed in U.S. application Ser. No. 08/315,401 and U.S. application Ser. No. 08/315,410 The flow control system 55 is then operated to fill the container 25 with liquid product as the container 25 is lowered from the nozzle by the carton lifter mechanism 90, preferably maintaining the flexible outlet extension 75 below the level of the liquid throughout its downward motion.

Figure 2:
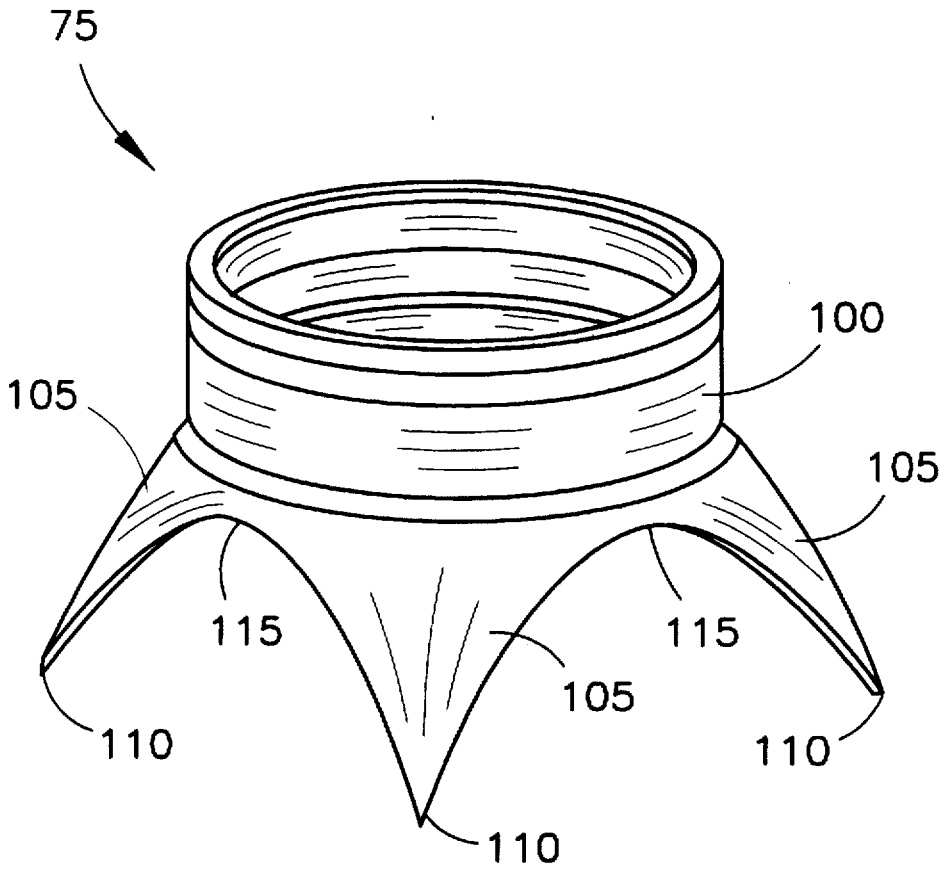
FIG. 2 is a perspective view of one embodiment of a flexible outlet extension for use in the disclosed apparatus.

FIG. 2 is a perspective view of one embodiment of the flexible outlet extension 75 of the present invention which is designed for use with a container having a square cross-section. As illustrated, the outlet extension 75 has a collar 100 that is sized for connection to the outlet portion of the fill pipe 40. The outlet extension 75 has a plurality of flaps 105 that extend from the collar 100. In the embodiment shown, the plurality of flaps 105 comprise four, V-shaped flaps only three illustrated here) that are disposed at about 90 degree intervals from one another about the periphery of the collar 100. Each V-shaped flap 105 includes a vertex 110. In the illustrated embodiment, the vertices 110 of adjacent flaps 105 are joined by a connecting portion 115 that, for example, defines an arch-shaped cutout between the adjacent vertices 110. As will be illustrated in further detail below, the flaps 105 are disposed to engage respective corners of the containers 25 during filling thereof.

It shall be understood that the flexible outlet extension 75 may be made from any suitable flexible material such as soft plastic or rubber of a suitable hardness. In the case of packaging foodstuffs, the nozzle may more preferably be made from nitrile, silicone rubber, or the like.

Figure 3:
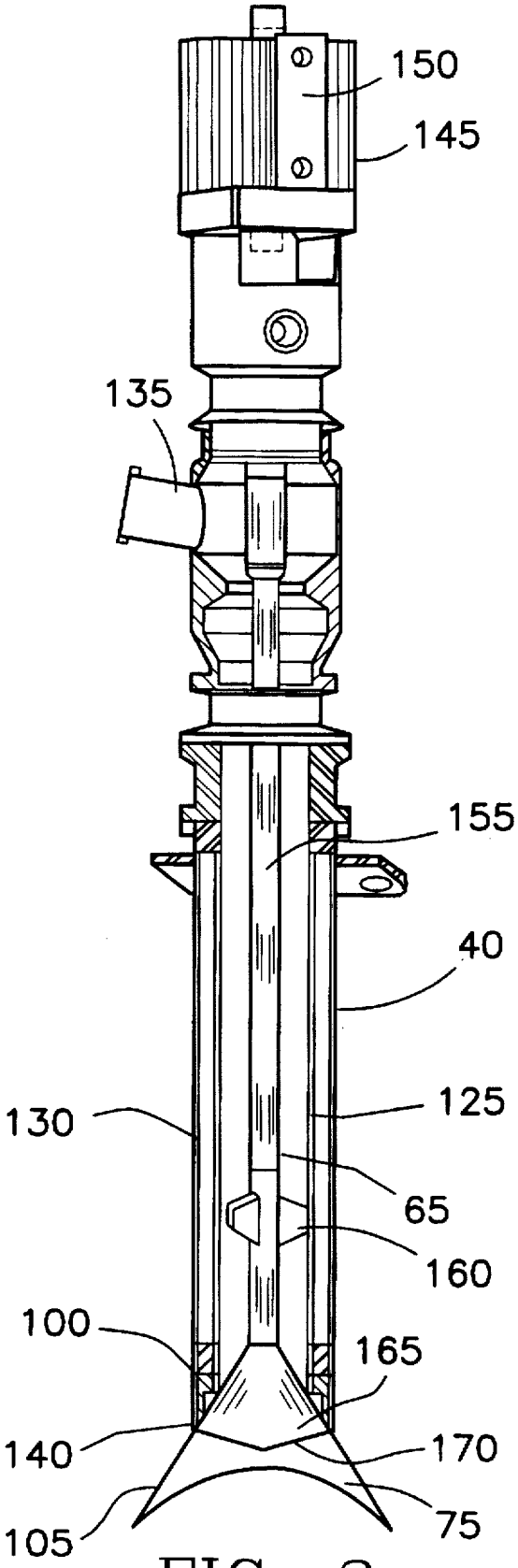
FIG. 3 is a cross-sectional view of an embodiment of a portion of the fill system of FIG. 1 including an umbrella valve assembly and a corresponding flexible outlet extension for reducing mixing between air and product during container filling.
Figure 4:
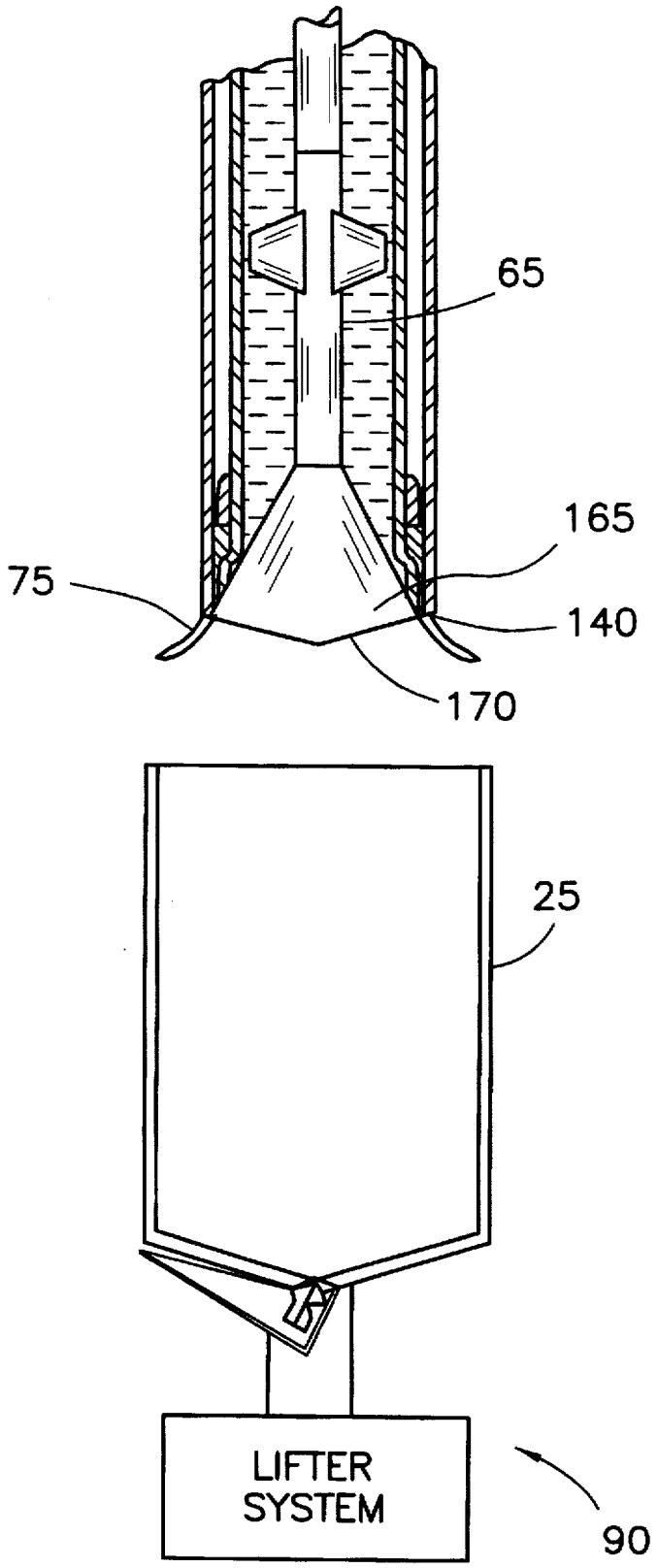
FIGS. 4–7 are cross-sectional views of the embodiment of the apparatus disclosed in FIG. 3 at various operational stages of a filling cycle.
Figure 5:
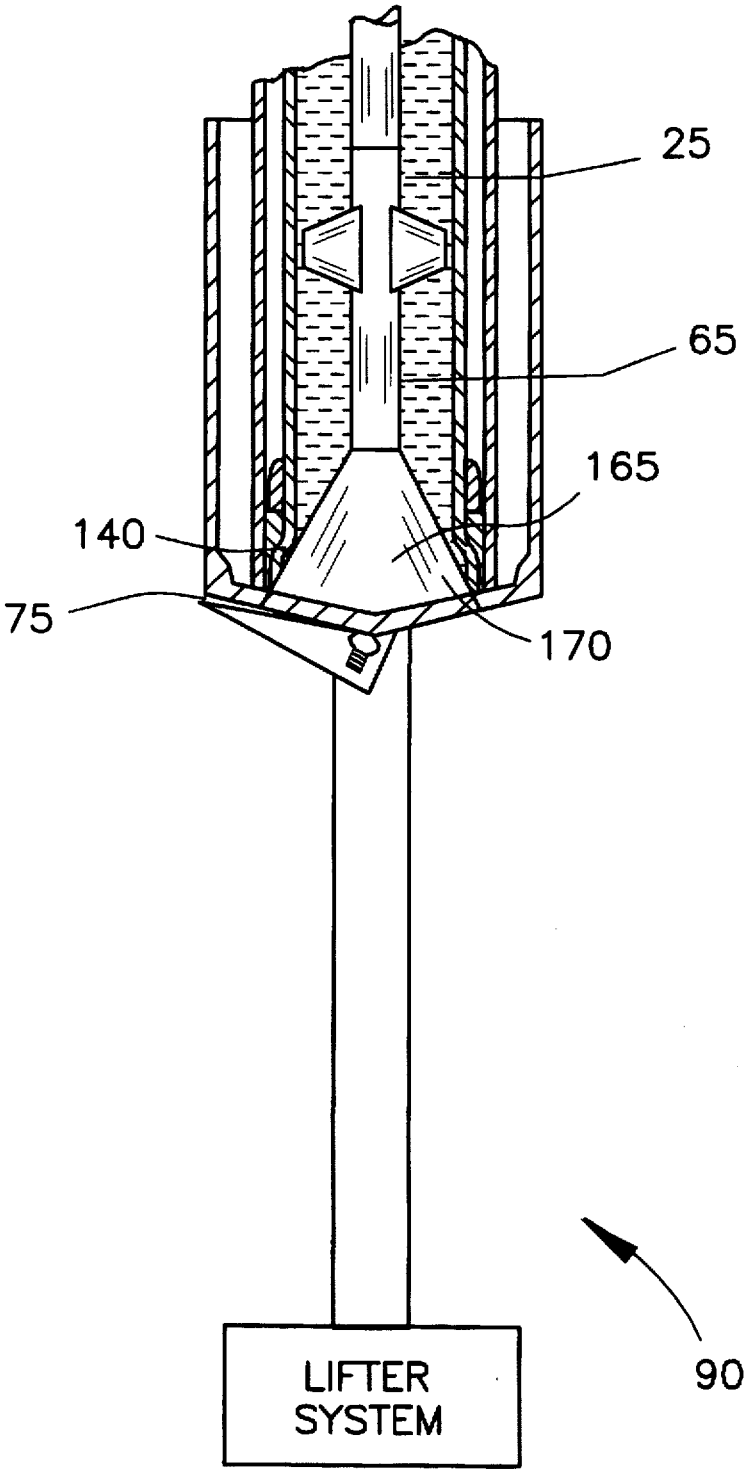
Figure 6:
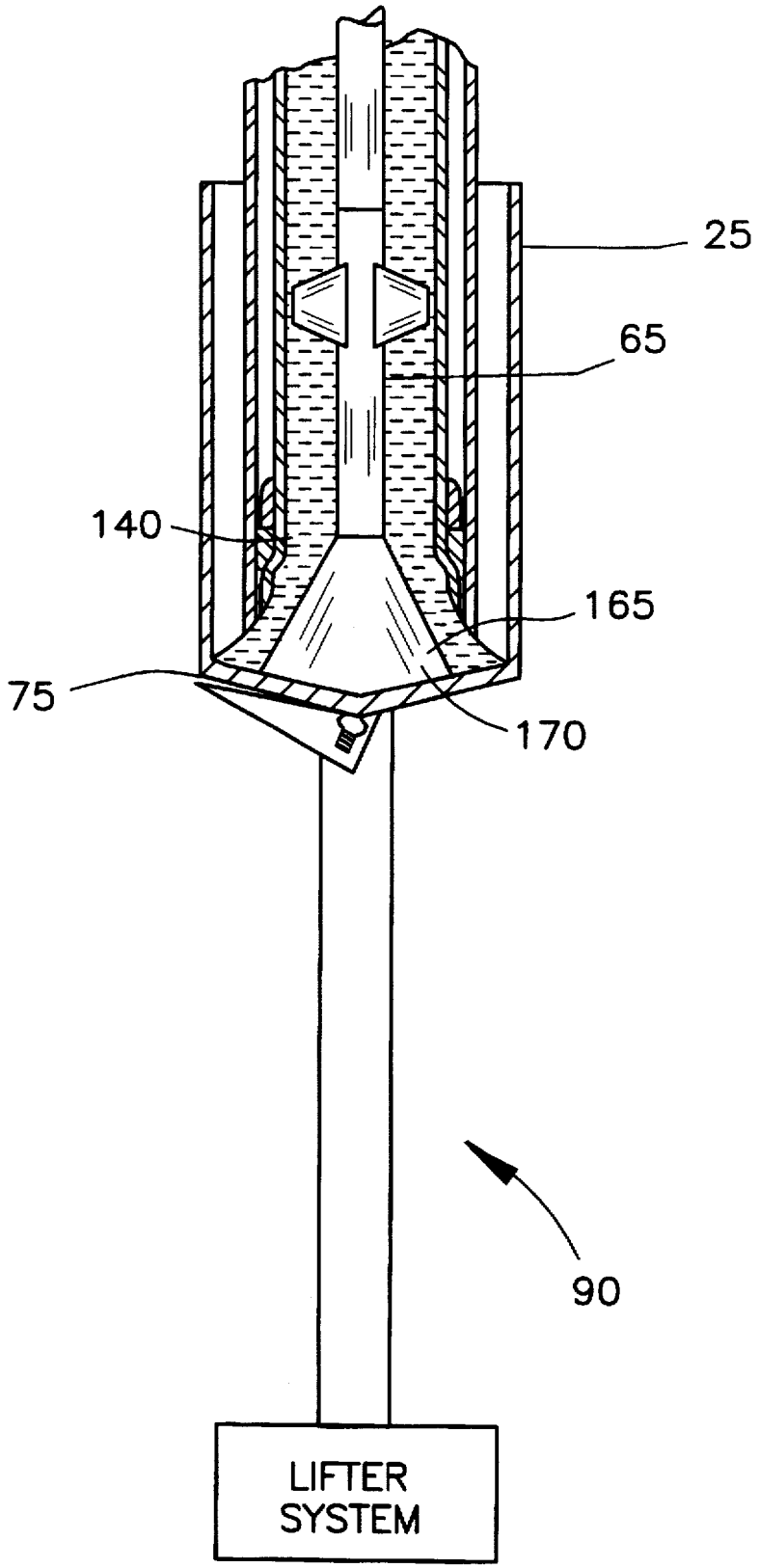
Figure 7:
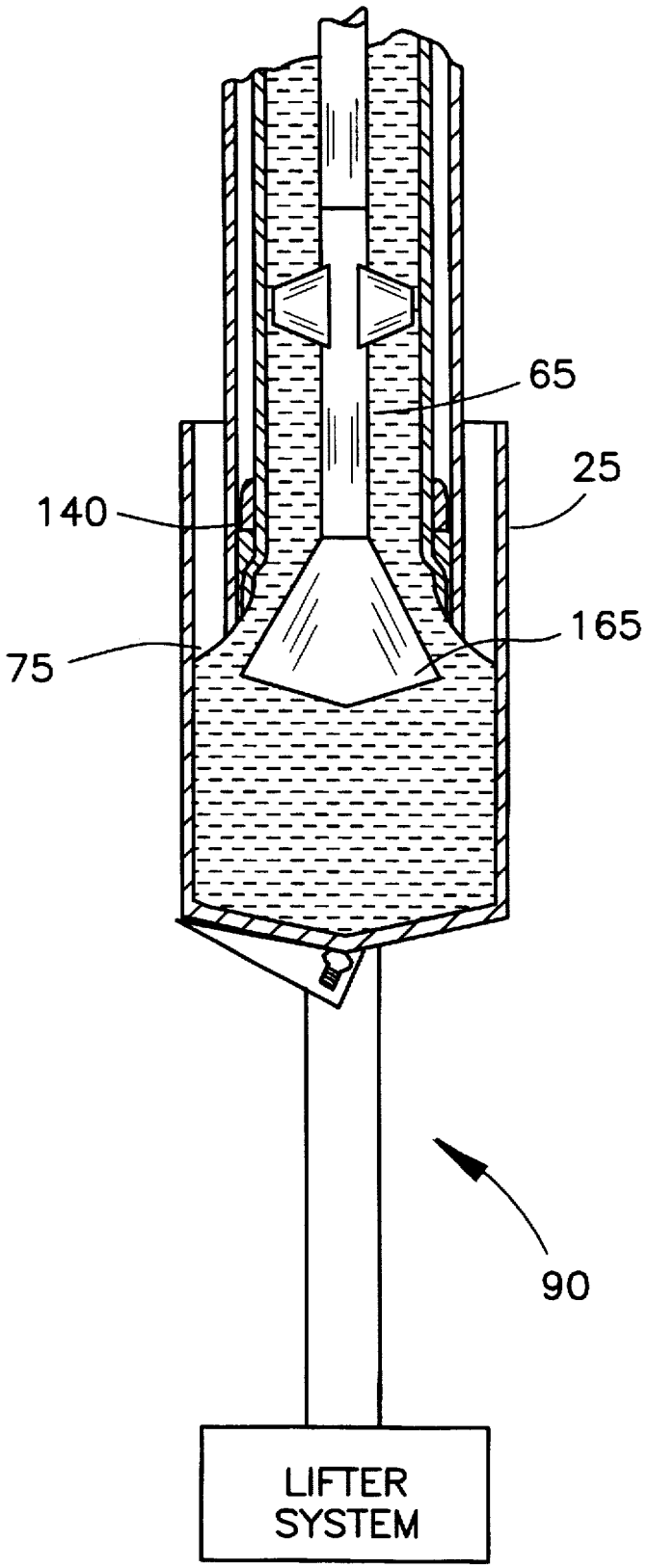

One embodiment of the present invention showing the relative connections between the umbrella valve assembly 65, fill pipe assembly 40, and flexible outlet extension 75 is shown in FIG. 3. As illustrated, the fill tube assembly 40 includes a primary fill pipe 125 that is concentrically disposed within an insulating pipe 130. The region between the insulating pipe 130 and primary fill pipe 125 is sealed at an upper portion at, for example, a joint at which the pipes 125 and 130 are connected to one another, and at a lower end by the collar 100 of the flexible outlet extension 75. Such an arrangement assists in reducing the likelihood that condensation at the exterior of the fill pipe assembly will enter the container therebelow when the system is used to dispense a cool product, such as refrigerated milk. The region between pipes 125 and 130 may be air or another type of thermal insulating material.

The primary fill pipe 125 accepts liquid product through an inlet pipe 135. Flow of the liquid product from the fill pipe 125 and into a container is principally controlled by the umbrella valve assembly 65.

The umbrella valve assembly, shown generally at 65, controls the flow of the product through the outlet 140 of the fill pipe 125. The assembly 65 includes an actuator 145 disposed at the upper portion of the fill tube 125. The actuator 145, for example, may include a pneumatically operated cylinder 150 that houses a piston that, in turn, is connected to actuate a valve rod 155 that is disposed concentrically within the fill pipe 125. The valve rod 155 includes flattened guide members 160 that may be arranged about the rod to provide support and alignment forces. A sealing member 165 is disposed on the valve rod 155 proximate the outlet 140 of the fill pipe 125. The sealing member 165 engages the outlet 140 to seal off the flow of product from the fill tube 125 when the actuator 145 moves the valve rod 155 and sealing member 165 to the illustrated position. The actuator 145 may be operated to move the valve rod 155 and sealing member 165 to a second position in which the sealing member 165 is disengaged from the outlet 140 thereby allowing the product to flow from the fill pipe 125. Details of one manner in which the sealing member 165 can be connected to the valve rod 155 are set forth in U.S. application Ser. No. 08/315,246, filed Sep. 29, 1994, entitled "Packaging Machine For Filling Primary And Secondary Products Into A Container", incorporated herein by reference.

The sealing member 165 includes a bottom portion 170 that is preferably shaped to the same contour as the internal bottom portion of the containers that are filled. In the illustrated embodiment, and as will be described in further detail below, the filling system 10 shown here is configured for filling a container having a gabled bottom structure. Such a gabled bottom structure is illustrated in U.S. Pat. No. 5,474,232, entitled "Gable Top Carton Having Top and Bottom Curved Creases". Accordingly, the bottom portion 170 of the sealing member 165 shown here comprises two sides that slope toward one another and join at a central location. It will be recognized, however, that the bottom portion 170 of the sealing member 165 may likewise be, for example, flattened to seal a container having a flat bottom. Other bottom contours may likewise be employed.

The collar 100 of the flexible outlet extension 75 is preferably secured with the outlet 140 of the fill pipe 125. In the illustrated embodiment, the collar 100 is disposed about the exterior portion of the outlet end of the fill pipe 125 and forms a seal between the insulating pipe 130 and the fill pipe 125. The flaps 105 extend past the outlet 140 in a generally unobstructed manner.

The advantages of the foregoing umbrella valve assembly 65 and corresponding flexible outlet extension 75 are exemplified in the filling process illustrated in FIGS. 4–7. In the exemplary filling process, the interior bottom portion of the container 25 and the outlet 140 are brought proximate one another while the umbrella valve assembly 65 is in a closed state sealing the outlet 140. In this relative position, the flaps 105 engage the interior corners of the container 25 to form at least a partial seal with the container bottom and sides. This initial engagement flushes a portion of the air from the filling area at the container bottom thereby decreasing the degree of mixing of product and air.

The umbrella valve assembly 65 is then urged to open the outlet 140 to allow product to begin filling the container 25. Preferably, the actuator 145 drives the bottom portion 170 of the sealing member 165 against the container bottom to thereby further flush air from the filling area. As product is dispensed into the container, the outlet 140 and container 25 are moved relative to one another by, for example, the foregoing lifter mechanism 90 to thereby begin extracting the outlet 140 from the interior of the container 25 during filling. At the beginning of the filling cycle, the umbrella shape of the sealing member 165 allows the product to follow the walls of the container 25 to thereby avoid turbulent flow. At the same time, the flow causes the edges of the flexible outlet extension 75 to engage the sidewalls of the container. During the extraction and filling process, the flaps 105 preferably continue to engage the corners and sidewalls of the interior of the container 25 and the motion profile used to cause the disengagement is preferably controlled to minimize, and more preferably eliminate, any air from entering the filling area beneath the outlet 140. Ultimately, the container 25 is filled with the desired volume of product and the outlet 140 and flexible outlet extension 75 are completely removed from the interior portion of the container.

In the illustrated embodiment, the container 25 is shown in an intermediate formed state in which the bottom has been sealed to form a gabled bottom structure. Other bottom structures, however, may be utilized as well.

It will be understood that the sealing member 165 and flexible outlet extension 75 of the present invention may take on any number of different forms which may substantially conform to the cross-sectional area and bottom contour of the package to be filled. For example, additional flaps 105 may be provided to conform to a container having a hexagonal cross-section. The number of flaps 105 may likewise be reduced to accommodate a container having a triangular cross-section.

While particular elements, embodiments and applications of the present invention have been shown and described, it will be understood, of course, that the invention is not limited thereto since modifications may be made by those skilled in the art, particularly in light of the foregoing teachings. It is, therefore, contemplated by the appended claims to cover such modifications as incorporate those features which come within the spirit and scope of the invention.

I claim:

1. A filling system comprising:

a container having a cross section defined by a plurality of sidewalls joined at a plurality of corner sections, an interior bottom engaging the sidewalls, and an open top;

a fill pump for pumping a liquid product;

a fill pipe having an inlet receiving liquid from the fill pump and an outlet overlying the container;

a flexible outlet extension extending from the outlet end of the fill pipe, the flexible outlet extension comprising a plurality of flaps formed from a flexible material;

moving means for relatively moving the container and outlet toward one another to a first position in which the flexible outlet extension is disposed proximate the interior bottom of the container and a second position in which the outlet is disposed distal from the interior bottom of the container, the flaps of the flexible outlet extension engaging the corner sections;

the fill pump operating to pump the liquid product through the fill pipe when the container and outlet are disposed in their relative first position, the flaps being dimensioned to substantially conform and seal with the corners and sidewalls of the container in the first position to thereby inhibit mixing of air and product as liquid product is dispensed into the container through the outlet and the moving means is operated to relatively move the container and nozzle from the first position to the second position.

2. A filling system as claimed in claim 1 and further comprising an umbrella valve for opening and sealing the outlet of the fill pipe.

3. A filling system as claimed in claim 2 wherein the umbrella valve comprises a sealing member movable between a first position in which the sealing member seals the outlet of the fill pipe and a second position in which the sealing member is disengaged from the outlet of the fill pipe.

4. A filling system as claimed in claim 3 wherein the sealing member comprises a bottom portion that is contoured to conform with the interior bottom of the container.

5. A filling system as claimed in claim 4 wherein the container comprises a gabled interior bottom structure.

6. A filling system as claimed in claim 1 wherein the container sidewalls define a square cross-section.

7. A filling system as claimed in claim 4 wherein the container sidewalls define a square cross-section.

8. A filling system as claimed in claim 7 wherein the plurality of flaps comprise first, second, third, and fourth, V-shaped flaps, each having vertices spaced at corners defining a square.

9. A filling system as claimed in claim 1 wherein the plurality of flaps comprise first, second, third, and fourth, V-shaped flaps, each having vertices spaced at corners defining a square.

10. A filling system comprising:

a container having a cross section defined by a plurality of sidewalls, adjacent sidewalls forming corners, an interior bottom engaging the sidewalls, and an open top;

a fill pump for pumping a liquid product;

a fill pipe having an inlet receiving liquid from the fill pump and an outlet overlaying the container;

a flexible outlet extension extending from the outlet end of the fill pipe;

moving means for relatively moving the container and outlet toward one another to a first position in which the flexible outlet extension is disposed proximate the interior bottom of the container and a second position in which the outlet is disposed distal from the interior bottom of the container;

the fill pipe operating to pump the liquid product through the fill pipe when the container and outlet are disposed in their relative first position, the flexible outlet extension being dimensioned to substantially conform and seal with the corners and sidewalls of the container in the first position to thereby inhibit mixing of air and product as liquid product is dispensed into the container through the outlet and the moving means is operated to relatively move the container and nozzle from the first position to the second position.

11. A filling system as claimed in claim 10 and further comprising an umbrella valve for opening and sealing the outlet of the fill pipe.

12. A filling system as claimed in claim 11 wherein the umbrella valve comprises a sealing member movable between a first position in which the sealing member seals the outlet of the fill pipe and a second position in which the sealing member is disengaged from the outlet of the fill pipe.

13. A filling system as claimed in claim 12 wherein the sealing member comprises a bottom portion that is contoured to conform with the interior bottom of the container.

14. A filling system as claimed in claim 13 wherein the container comprises a gabled interior bottom structure.

15. A filling system as claimed in claim 10 wherein the container sidewalls define a square cross-section.

16. A filling system as claimed in claim 13 wherein the container sidewalls define a square cross-section.

17. A filling system as claimed in claim 10 wherein the flexible outlet extension comprises a plurality of flaps.

18. A filling system as claimed in claim 17 wherein the plurality of flaps comprise first, second, third, and fourth, V-shaped flaps, each having vertices spaced at corners defining a square.

19. A filling system for filling a container having a bottom portion and a plurality of sidewalls defining a container cross-section, the filling system comprising:

a fill pipe having a product inlet and a product outlet;

a valve rod disposed in the fill pipe;

an umbrella-shaped sealing member having a bottom portion, the valve rod and the sealing member being movable between a first position in which the sealing member engages and seals the product outlet and a second position in which the sealing member is disengaged from the product outlet, the bottom portion of the sealing member being shaped to conform to the bottom portion of the container;

a flexible outlet extension extending from the product outlet and dimensioned to engage and conform to the sidewalls of the container during filling.

20. A filling system as claimed in claim 19 wherein the flexible outlet extension comprises a plurality of flaps.

21. A filling system as claimed in claim 20 wherein the plurality of flaps comprise first, second, third, and fourth, V-shaped flaps, each having vertices spaced at corners defining a square.

22. A filling system for filling a container having a bottom portion and a plurality of sidewalls defining a container cross-section, the bottom portion of the container comprising a plurality of sloped walls, the filling system comprising:

a fill pipe having a product inlet and a product outlet;

a valve rod disposed in the fill pipe;

an umbrella-shaped sealing member having a bottom portion, the valve rod and the sealing member being movable between a first position in which the sealing member is disengaged from the product outlet, the bottom portion of the sealing member being shaped to conform to the sloped walls of the bottom portion of the container;

a flexible outlet extension extending from the product outlet and dimensioned to engage and conform to the sidewalls of the container during filling of the container.

23. A filling system as claimed in claim 22 wherein the flexible outlet extension comprises a plurality of flaps.

24. A filling system as claimed in claim 23 wherein the plurality of flaps comprise first, second, third, and fourth, V-shaped flaps, each having vertices spaced at corners defining a square.

25. A method for filling a container comprising:

providing a container beneath a fill pipe of a filling machine, the container having sidewalls defining a predetermined cross-section;

bringing a bottom portion of the container and a flexible outlet extension that is disposed at an outlet end of a fill pipe proximate one another;

pumping a liquid product through the fill pipe, the flexible outlet extension generally engaging and conforming to the sidewalls of the container during filling of the container to thereby inhibit mixing of the liquid product and air during filling.

26. A method as claimed in claim 25 and wherein the container of the providing step comprises a bottom portion having sloped walls, the method further comprising the steps of:

providing an umbrella valve assembly having an umbrella shaped sealing member movable to open and close the outlet end of the fill pipe, the sealing member having a bottom that conforms to the sloped walls of the bottom of the container; and urging the bottom portion of the sealing member against the interior bottom of the container for engagement during initial filling of the container.

* * * * *